US012404674B2

(12) United States Patent
Tompane

(10) Patent No.: US 12,404,674 B2
(45) Date of Patent: Sep. 2, 2025

(54) FRAME ARRANGEMENT FOR WOOD FRAMED BUILDINGS

(71) Applicant: Kyle Tompane, San Diego, CA (US)

(72) Inventor: Kyle Tompane, San Diego, CA (US)

( * ) Notice: Subject to any disclaimer, the term of this patent is extended or adjusted under 35 U.S.C. 154(b) by 0 days.

(21) Appl. No.: 18/208,609

(22) Filed: Jun. 12, 2023

(65) Prior Publication Data

US 2023/0392373 A1 Dec. 7, 2023

Related U.S. Application Data

(63) Continuation of application No. 17/394,720, filed on Aug. 5, 2021, and a continuation-in-part of application No. 17/394,737, filed on Aug. 5, 2021.

(60) Provisional application No. 63/109,525, filed on Nov. 4, 2020, provisional application No. 63/109,528, filed on Nov. 4, 2020.

(51) Int. Cl.

| | |
|---|---|
| ***E04B 1/26*** | (2006.01) |
| ***E04B 2/70*** | (2006.01) |
| ***E04B 5/12*** | (2006.01) |
| ***E04B 7/02*** | (2006.01) |

(52) U.S. Cl.

CPC ..... *E04B 5/12* (2013.01); *E04B 1/2612* (2013.01); *E04B 2/70* (2013.01); *E04B 7/022* (2013.01)

(58) Field of Classification Search

CPC . E04B 1/2612; E04B 2/70; E04B 5/12; E04B 7/022

USPC ..... 52/633

See application file for complete search history.

(56) References Cited

U.S. PATENT DOCUMENTS

| | | | | | |
|---|---|---|---|---|---|
| 1,372,206 | A * | 3/1921 | Stadelman | E04B 1/10 | 52/92.1 |
| 1,689,642 | A * | 10/1928 | Rappleyea | E04B 2/62 | 52/645 |
| 2,355,192 | A * | 8/1944 | Wachsmann | E04B 1/10 | 52/584.1 |
| 2,389,573 | A * | 11/1945 | Balduf | E04B 1/30 | 52/234 |
| 3,813,832 | A * | 6/1974 | Caplan | E04B 1/355 | 52/746.1 |
| 3,845,595 | A * | 11/1974 | Abrams | E04B 1/34838 | 52/92.3 |
| 4,040,232 | A * | 8/1977 | Snow | E04B 2/56 | 52/657 |

(Continued)

*Primary Examiner* — James J Buckle, Jr.

(74) *Attorney, Agent, or Firm* — James A. Italia; Italia IP

(57) ABSTRACT

A method of constructing a frame of a wood frame building structure is shown and described. The method entails fabricating modules establishing nominally flat structural platforms for expediting assembly of floors, walls, ceilings, and a roof. These modules provide structural frames enabling appropriate finishing materials to be affixed thereto. The finishing materials provide continuous, flat surfaces, with exceptions for penetrations. The method includes assembling the modules such that a longitudinal axis of each model is parallel to those of other modules throughout the frame and perpendicular to a building length axis. Also, each module includes ceiling joists, floor joists, and roof rafters, as appropriate, such joists and roof rafters installed parallel to the building length axis and therefore, perpendicular to the joists and roof rafters. This method minimizes assembly costs of modules and of the framing, while retaining conventional framing performance.

2 Claims, 5 Drawing Sheets

(56) References Cited

U.S. PATENT DOCUMENTS 4,272,930 A * 6/1981 Foster ..... E04H 1/005 52/646
4,441,286 A * 4/1984 Skvaril ..... E04B 1/34815 52/234
4,563,851 A * 1/1986 Long ..... E04C 2/386 52/656.1
4,569,167 A * 2/1986 Staples ..... E04B 1/04 52/766
4,967,520 A * 11/1990 Post, Jr. ..... E04B 1/34336 52/79.5
5,333,426 A * 8/1994 Varoglu ..... E04B 1/26 52/236.7
5,353,560 A * 10/1994 Heydon ..... E04B 7/22 52/592.1
5,657,606 A * 8/1997 Ressel ..... E04C 3/08 52/690
5,765,330 A * 6/1998 Richard ..... E04C 2/386 52/270
6,308,469 B1 * 10/2001 Leung ..... E04B 1/10 52/693
6,389,778 B1 * 5/2002 Strange ..... E04B 1/08 52/690
6,460,297 B1 * 10/2002 Bonds ..... E04B 1/08 52/234
7,127,856 B2 * 10/2006 Hagen, Jr. ..... E04B 1/7604 52/407.3
7,835,810 B2 * 11/2010 Mifsud ..... B23P 21/004 700/98
7,856,786 B2 * 12/2010 Beck ..... E04B 1/24 52/92.1
8,397,454 B2 * 3/2013 Commins ..... E04H 9/14 52/800.18
8,528,294 B2 * 9/2013 Vanker ..... E04C 3/40 52/270
8,688,411 B2 * 4/2014 Vanker ..... E04B 1/08 703/1
8,925,283 B2 * 1/2015 Lemieux ..... E04B 5/12 52/745.1
10,036,159 B2 * 7/2018 Rotter ..... E04B 1/2608
10,385,583 B2 * 8/2019 Rotter ..... E04H 9/021
10,683,661 B2 * 6/2020 Bigelow ..... E04F 21/1805
10,762,248 B2 * 9/2020 Kang ..... G06F 30/13
2006/0112657 A1 * 6/2006 Abbot-Wilcox ..... E04B 1/2604 52/633
2007/0213960 A1 * 9/2007 Freet ..... E04B 7/22 703/1
2009/0044480 A1 * 2/2009 Bonds ..... E04B 5/40 52/843
2013/0305629 A1 * 11/2013 Stephenson ..... E04H 1/005 52/79.9
2016/0348369 A1 * 12/2016 Godfrey ..... E04B 7/20
2023/0148153 A1 * 5/2023 Jobson ..... E04H 6/02 52/79.7

* cited by examiner

FRAME ARRANGEMENT FOR WOOD FRAMED BUILDINGS

CROSS-REFERENCE TO RELATED APPLICATIONS

This application is a Continuation Application of U.S. Non-Provisional patent application Ser. No. 17/394,720, filed Aug. 5, 2021, which is a Continuation in Part of U.S. Non-Provisional patent application Ser. No. 17/394,737, filed Aug. 5, 2021, both of which rely on the disclosure of and claim priority to and the benefit of the filing date of U.S. Provisional Application Nos. 63/109,525, and 63/109,528 both of which were filed on Nov. 4, 2020, the disclosure of all referenced applications are hereby incorporated in their entirety by this reference.

FIELD OF THE INVENTION

The present invention relates to construction of wood frame buildings, and more particularly to modules finding utility in building wood frames for buildings.

BACKGROUND OF THE INVENTION

Construction of wood framed buildings is most commonly performed by cutting and coupling individual boards at a construction site. It is desirable to minimize labor in building construction because labor is one of the most expensive inputs in the construction process. Additionally, using human labor generates a certain amount of waste of material.

One answer to the issue of economy is the use of prefabricated modular panels, or modules. This practice is frequently used for certain generally irregular shaped components, such as triangular trusses for supporting a roof Such components are generally large and labor intensive to build by hand Reliance on modules for building extensive platforms such as floors, ceilings, and roofs has not met with widespread commercial success.

Greater economies than currently practiced could be realized if there were practical ways to utilize modules for extensive platforms.

SUMMARY OF THE INVENTION

The present invention addresses the above stated need by proposing advantageous schemes to incorporate modules into extensive platforms, and by proposing compliant modules arranged advantageously for automated assembly procedures.

In one aspect, the present invention sets forth a method of constructing a frame of a wood frame building structure, the method enabling use of expeditiously fabricated modules. The method comprises fabricating modules establishing nominally flat structural platforms for expediting assembly of floors, walls, ceilings, and a roof. These modules provide structural frames enabling appropriate finishing materials to be affixed thereto. The finishing materials provide continuous, flat surfaces, with exceptions for penetrations such as doors, windows, access passages for heating, cooling, and ventilating ducts, plumbing, wiring, and the like.

Modules enable expedited assembly of the building frame, while retaining conventional advantages of otherwise conventional wood framing.

Beyond merely using modules, the present invention contemplates assembling the modules such that a longitudinal axis of each model is parallel to those of other modules throughout the frame and perpendicular to a building length axis. Also, each module includes ceiling joists, floor joists, and roof rafters, as may be appropriate, such joists and roof rafters installed parallel to the building length axis and therefore, perpendicular to the joists and roof rafters.

This arrangement contributes to structural integrity of the building frame, while accommodating expeditious and advantageous assembly of modules into the building frame, and enables economies to be realized when building the modules in a facility remote from the building being constructed.

It is anticipated that standardizing layout of wall, floor, and roof modules as to top and bottom plates, and joists or rafters, costs of machinery, manpower, and factory spaced may be reduced by a factor of three, allowing additional savings over module costs set forth above. It should further be observed that the novel assembly concept enables modules to be built using a minimum of different lumber sizes. This reduces inventory and storage costs to the module manufacturer.

Another benefit is that of improved sound proofing. It is anticipated that whereas a conventionally framed and insulated wall or floor system receives an expected Sound Transmission Class (STC) rating of 38, using novel modules where conventional twelve inch wide joists or roof rafters would be used yields an STC rating of 58.

Still additional benefits include improved thermal insulation performance. Because joists in the novel modules are provided in two vertically separated sections rather than one continuous joist (e.g., two two inch by six inch joists rather than one two inch by twelve inch joist), and with horizontal spacing as well, thermal and acoustic performance both increase.

The present invention provides improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

Figure 1:
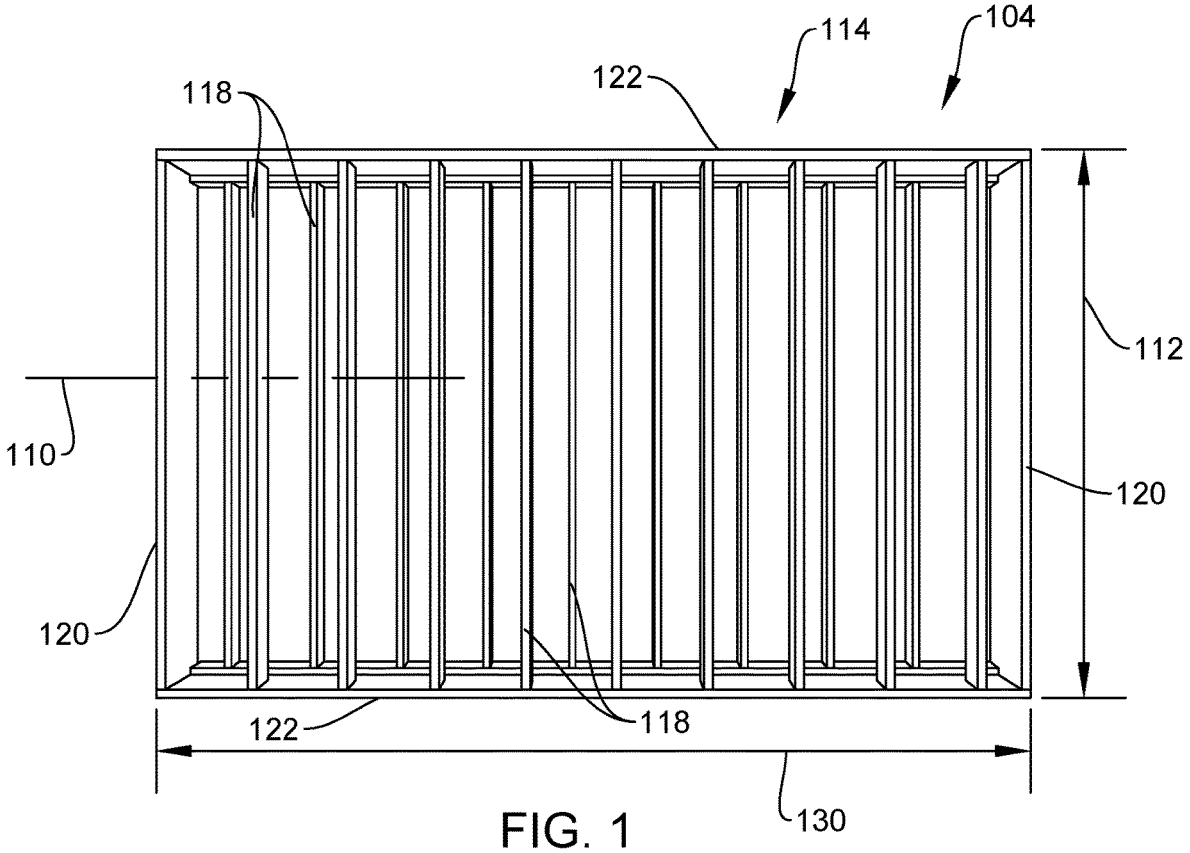
FIG. 1 is a plan view of one type of module used in the present method and building.

Drawings 1-7 are drawn to internal scale, but not necessarily to external scale. By internal scale it is meant that the parts, components, and proportions thereof in the illustrated inventive example are drawn to scale relative to one another. As employed herein, external scale refers to scale of the illustrated example relative to scale of environmental elements or objects, regardless of whether the latter are included in the drawings. Where the inventive example claims external scale, the inventive and environmental elements may of course not be drawn to real or true life scale; rather, external scale signifies only that both the invention and environmental elements are drawn in scale to each other.

DETAILED DESCRIPTION

Figure 2:
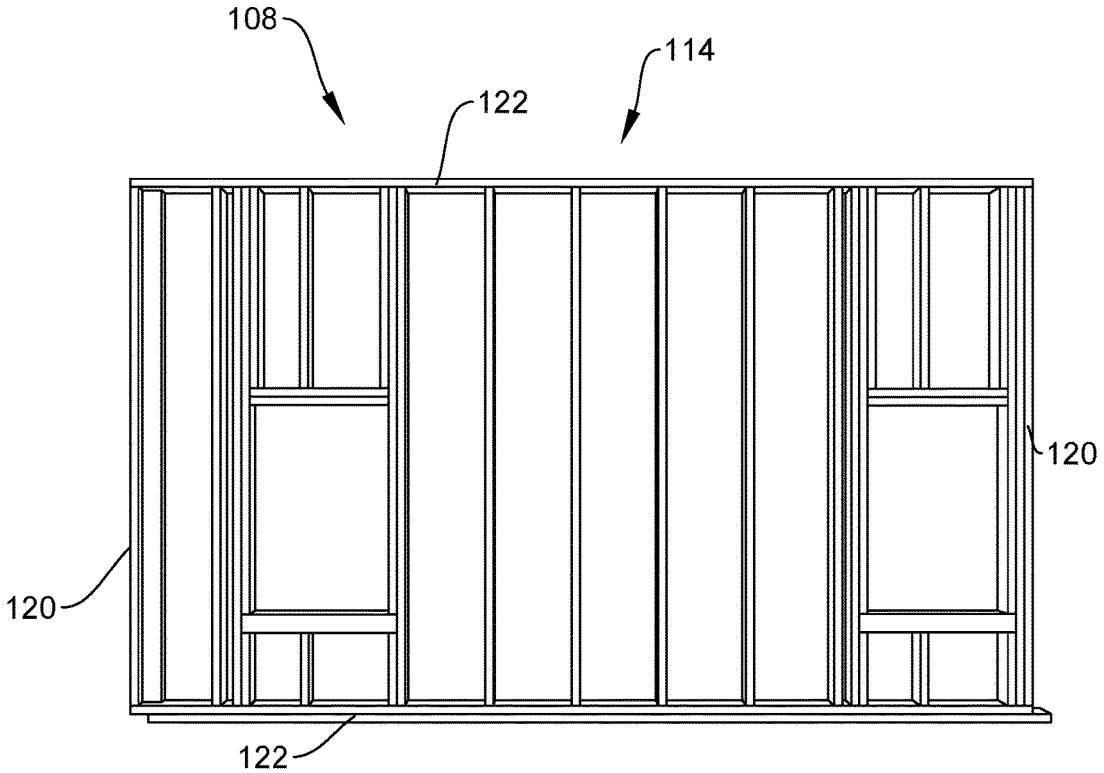
FIG. 2 is a plan view of a second type of module used in the present method and building.
Figure 3:
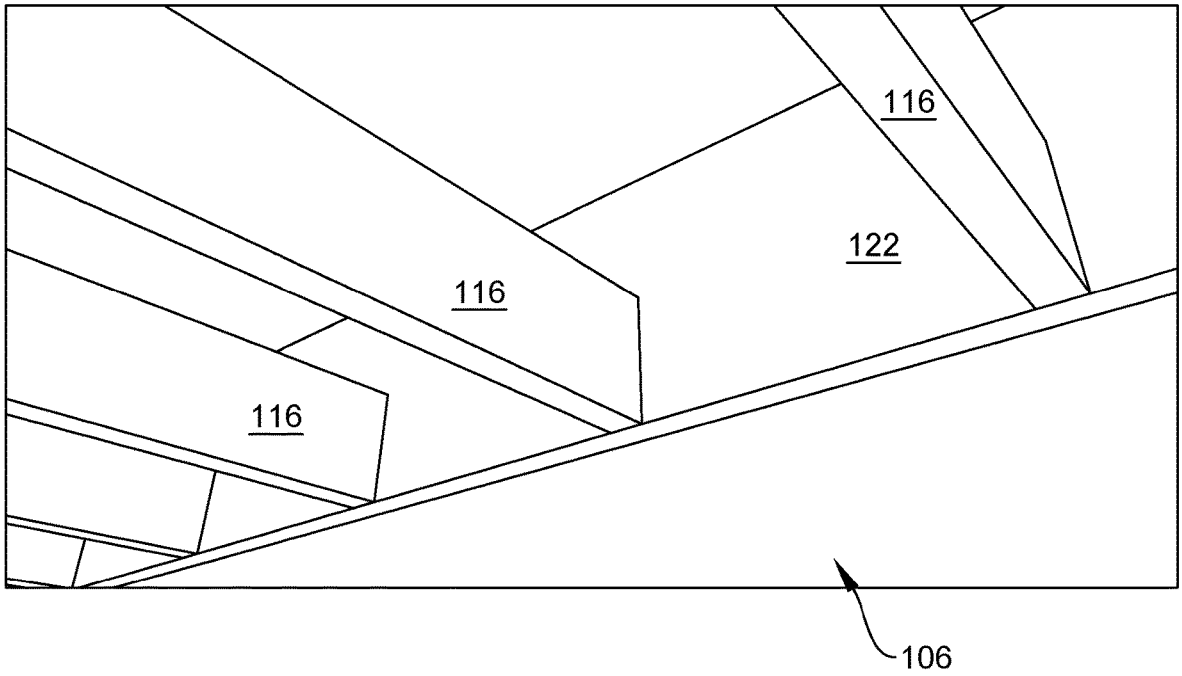
FIG. 3 is a plan view of a third type of module used in the present method and building.

Referring first to FIGS. 1-3, according to at least one aspect of the invention, there is shown a method of constructing a frame 100 (FIG. 5) of a wood frame building structure (not shown in its entirety) having a building length axis 102. The method enables use of expeditiously fabricated modules 104, 106, 108. The method comprises fabricating a plurality of modules 104, 106, 108 including floor or roof modules 104, ceiling modules 106, and wall modules 108. Each module 104, 106, or 108 comprises a module length axis 110, a module width 112, a bounded wood perimeter 114, and ceiling joists 116, floor joists 118 or roof rafters 118 oriented perpendicularly to length axis 110. The method further comprises building framing 100, and assembling frame 100 of the wood frame building structure using modules 104, 106, and 108, wherein floor modules 104, ceiling modules106, and wall modules 108 are coupled to the building wall framing 100 with respective module length axes 110 perpendicular to building length axis 102. Ceiling joists 116, floor joists or roof rafters 118 are parallel to building length axis 102.

Figure 6:
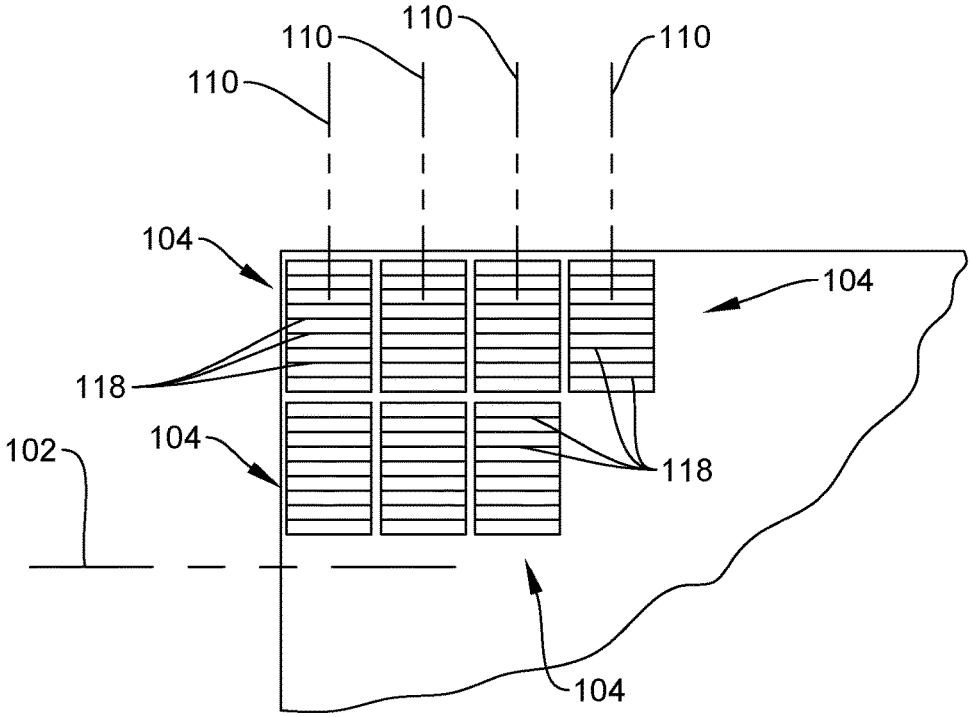
FIG. 6 is a schematic partial plan view of a deck of a building.
Figure 4:
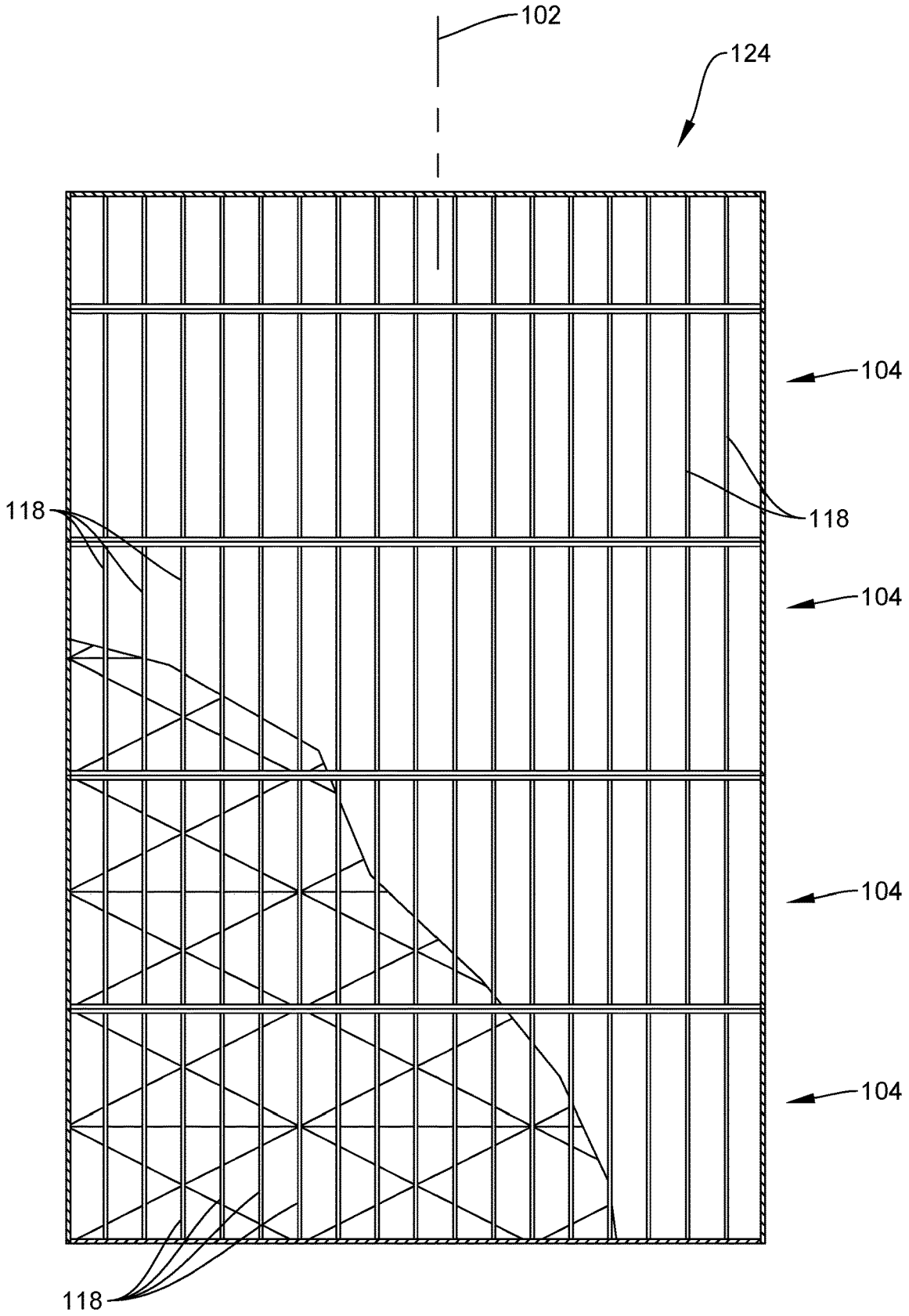
FIG. 4 is a plan view of a complete deck of a building built by the present method.

The relationship of modules 104, 106, 108 to frame 100 of the building structure is shown for emphasis in FIG. 6. All modules 104, 106, 108 (represented by module 104 in the example of FIG. 6) are oriented with module length axes 110 perpendicular to building length axis 102. Consequently, joists and rafters (represented by joists 118) are parallel to building length axis 102. A more literal rendering is seen in FIG. 4, the latter showing a completed deck 124. Deck 124 is a flat surface having a depth extending vertically, and accounts for a footprint area of the building under construction, e.g., a first story floor, a second story floor, etc.

Bounded wood perimeter 114 comprises end boards 120 and top and bottom boards 122. End boards 120 and top and bottom boards 122 collectively establish perimetric bounds of all modules 104, 106, 108. An exception is modification to prefabricated modules 104, 106, 108 to accommodate a misfit between module size and remaining area of a frame 100 remaining to be built. This situation occurs when a floor plan has a footprint area that does not jibe with area coverage of a whole number plurality of modules 104, 106, 108, and a portion of frame 100 must be custom built.

Floor and roof modules 104 are structurally and functionally similar, and therefore share a common reference numeral. Because of this, both joist boards and roof rafters are designated with the singular reference numeral 118.

In the method, the step of building wall framing 100 comprises building at least a portion of building wall framing 100 from rectangular wall modules 108 each including a bounded wood perimeter 114 and having a longitudinal wall module axis 110 and structural timbers arranged perpendicularly to longitudinal wall module axis 110, and coupled to bounded wood perimeter 114. Alternatively stated, constructing only part of a building using the novel method is regarded as within the scope of the inventive method.

Figure 5:
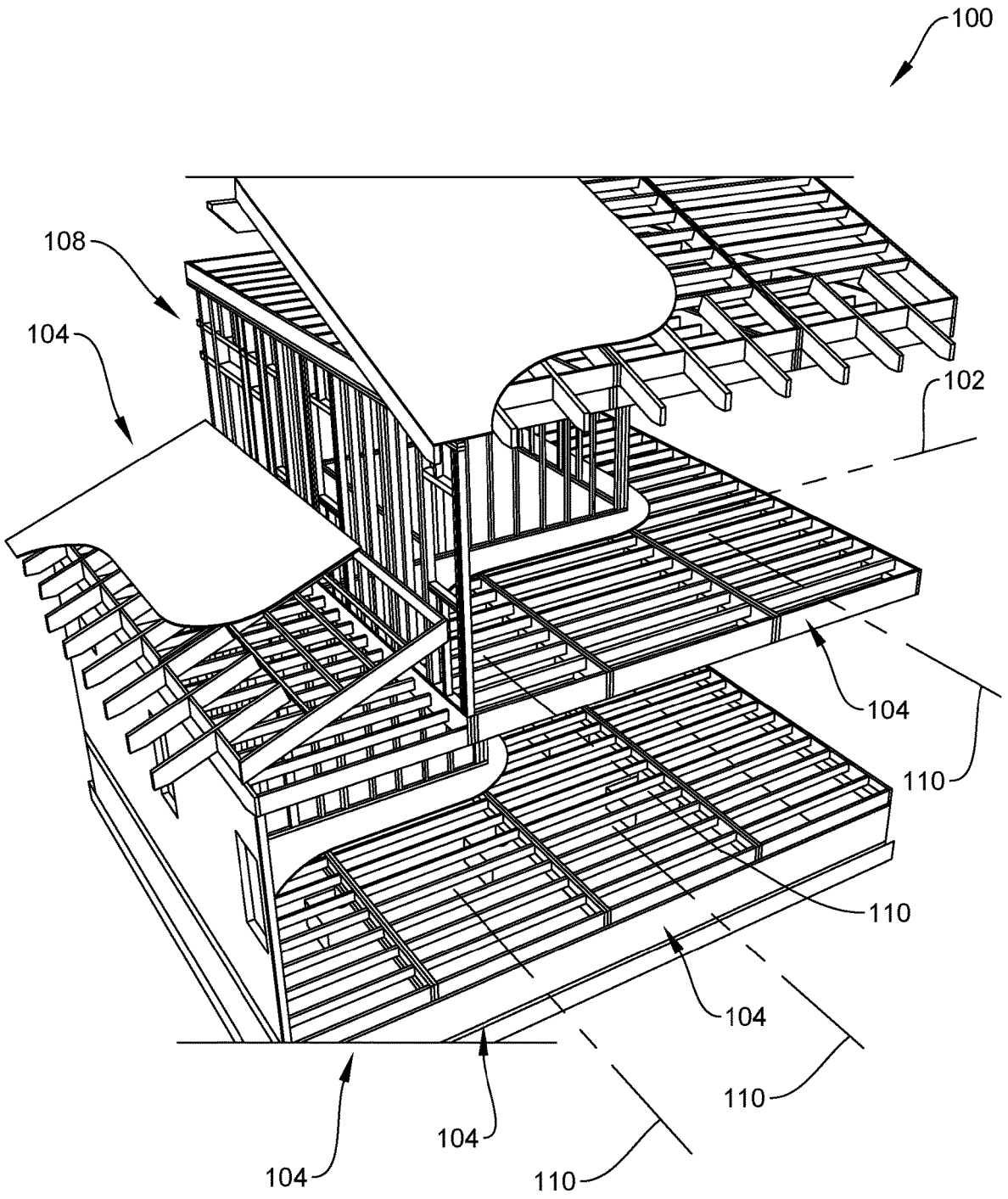
FIG. 5 is a perspective view of a building frame supported on a foundation, partially broken away to reveal internal detail.

In the method, each module 104, 106, or 108 abuts another module 104, 106, 108 when installed to frame 100. This is shown in FIG. 5. FIG. 6 is an exaggerated view showing modules 104 slightly separated only for clarity of understanding.

In the method, floor modules 104 and roof modules 104 comprise upper joist boards 118 and lower joist boards 118 parallel to upper joist boards 118 and lower joist boards 118 of every other respective said floor module 104 or roof module 104. This is illustrated in the perspective view of FIG. 1. Further description of upper and lower joist boards 118 may be obtained from the copending application referenced at the beginning of this application.

Figure 7:
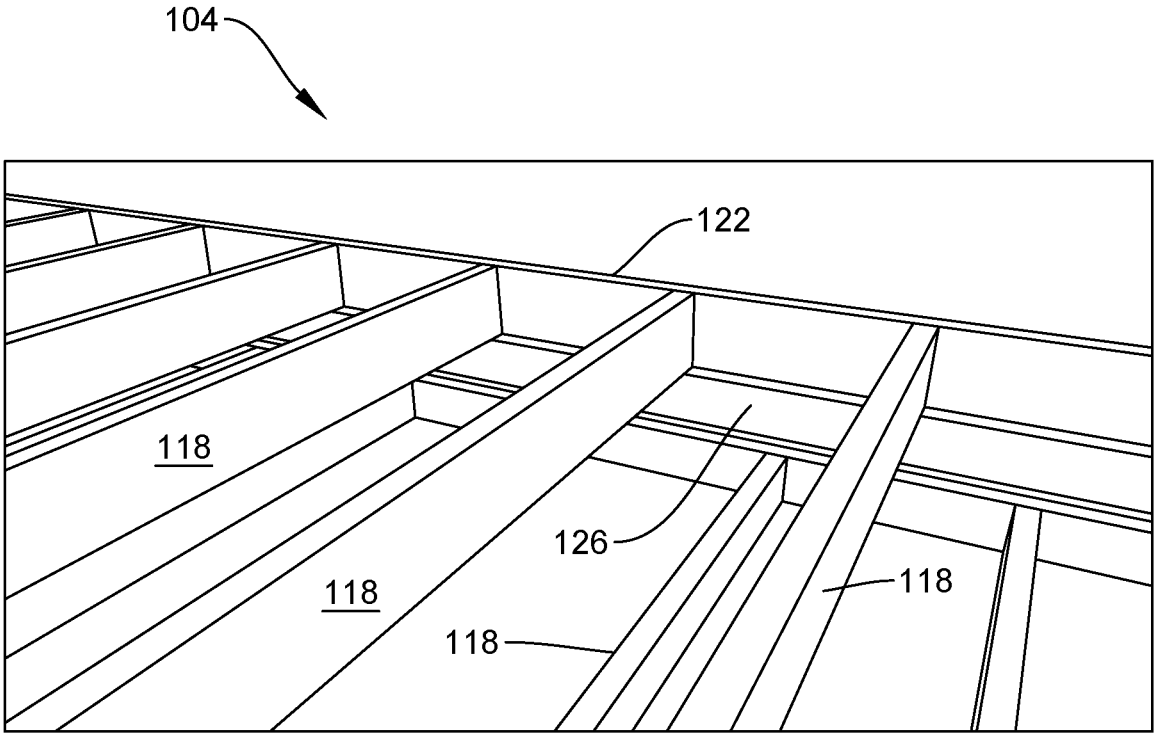
FIG. 7 is a top perspective detail view of a variant of the module of FIG. 1.

In the method, at least one module 104, 106, or 108 may optionally include at least one ledger board 126. This is shown in FIG. 7, where ledger board 126 supports upper joists 118.

In the method, the step of fabricating a plurality of modules 104, 106, 108 may further comprise fabricating floor modules 104 and roof modules 104, the ceiling modules 106, and the wall modules 108 to be identical in length 130 (shown for floor and roof module 104 in FIG. 1) and width 112 (FIG. 1).

In the method, the step of fabricating a plurality of modules 100, 106 further comprises fabricating floor modules 100, roof modules 100, and ceiling modules 106 to be identical in size and in spacing of floor joists 118, roof rafters 118, and ceiling joists 116.

Referring to all Drawing Figs., the invention may be thought of as a wood frame building structure having a wood frame 100 and a building length axis 102. The wood frame building structure may comprise a plurality of floor modules 104 or roof modules 104 coupled to wood frame 100, and a plurality of ceiling modules 106 coupled to wood frame 100. Each floor module 104 has module length axis 110 oriented perpendicularly to building length axis 102, bounded wood perimeter 114, and floor joists 118 oriented perpendicularly to module length axis 110. Each roof module 104 has module length axis 110 oriented perpendicularly to building length axis 102, bounded wood perimeter 114 and roof rafters 118 oriented perpendicularly to module length axis 110. Ceiling module 106 has module length axis 110 oriented perpendicularly to building length axis 102, bounded wood perimeter 114 and ceiling joists 116 oriented perpendicularly to module length axis 110. Each floor module 104 abuts another floor module 104 when installed to frame 100. Each ceiling module 106 abuts a floor module 104 when installed to frame 100. Each roof module 104 abuts another roof module when installed to frame 100. Floor modules 104, roof modules 104, and ceiling modules 106 are identical in length 130 and width 112, and are identical in spacing apart of floor joists 118, roof rafters 118, and ceiling joists 116.

In the wood frame building structure, floor modules 104 and ceiling modules 106 comprise upper joist boards 118 or 116 and lower joist boards 118 or 116 parallel to upper joist boards 118 or 116 and lower joist boards 118 or 116 of every other respective floor module 104 or ceiling module 106. Upper and lower joist boards 118 or 116 are spaced apart vertically, to generate an open space therebetween. This open space enables ready installation of heating, air conditioning, and ventilating ducts, plumbing, and wiring in floors and ceilings.

Optionally, in the wood frame building structure, at least one module 104, 106, or 108 includes at least one ledger board 126 (FIG. 7) supporting at least one other structural component of the wood frame building structure.

It should be noted at this point that orientational terms such as vertically, top, bottom, upper, and lower refer to the subject drawing as viewed by an observer. The drawing figures depict their subject matter in orientations of normal use, which could obviously change with changes in posture and position of the novel modules not installed conventionally within the building under construction. Therefore, orientational terms must be understood to provide semantic basis for purposes of description, and do not limit the invention or its component parts in any particular way.

The present invention is susceptible to modifications and variations which may be introduced thereto without departing from the inventive concepts. For example, While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

I claim:

1. A wood frame building structure having a wood frame and a building length axis, the wood frame building structure comprising:

a plurality of floor modules coupled to the wood frame;

a plurality of roof modules coupled to the wood frame; and a plurality of ceiling modules coupled to the wood frame; wherein each said floor module has a module length axis oriented perpendicularly to the building length axis, a bounded wood perimeter and a plurality of floor joists oriented perpendicularly to the module length axis and surrounded by the bounded wood perimeter of said floor module;

each said roof module has a module length axis oriented perpendicularly to the building length axis, a bounded wood perimeter and a plurality of roof rafters oriented perpendicularly to the module length axis and surrounded by the bounded wood perimeter of said roof module;

each said ceiling module has a module length axis oriented perpendicularly to the building length axis, a bounded wood perimeter and a plurality of ceiling joists oriented perpendicularly to the module length axis and surrounded by the bounded wood perimeter of said ceiling module;

each said floor module abuts another said floor module when installed to the frame;

each said ceiling module abuts another said ceiling module when installed to the frame; and each said roof module abuts another said roof module when installed to the frame;

the floor modules, the ceiling modules, and the roof modules are identical in length and width, and are identical in spacing apart of floor joists, ceiling joists, and roof rafters; and wherein the floor joists of each of said floor modules and the ceiling joists of each of said ceiling modules comprise upper joist boards and lower joist boards parallel to upper joist boards and lower joist boards of every other respective said floor module or ceiling module, wherein for each of said floor modules and each of said ceiling modules, a top edge of the upper joist boards is not coplanar to a top edge of the lower joist boards.

2. The wood frame building structure of claim 1, wherein at least one said module includes at least one ledger board supporting at least one other structural component of the wood frame building structure.

* * * * *